US008428269B1

(12) United States Patent
Brungart et al.

(10) Patent No.: US 8,428,269 B1
(45) Date of Patent: Apr. 23, 2013

(54) HEAD RELATED TRANSFER FUNCTION (HRTF) ENHANCEMENT FOR IMPROVED VERTICAL-POLAR LOCALIZATION IN SPATIAL AUDIO SYSTEMS

(75) Inventors: Douglas S. Brungart, Rockville, MD (US); Griffin D. Romigh, Pittsburgh, PA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 295 days.

(21) Appl. No.: 12/783,589

(22) Filed: May 20, 2010

Related U.S. Application Data

(60) Provisional application No. 61/179,754, filed on May 20, 2009.

(51) Int. Cl.
*H04S 5/00* (2006.01)
*H04R 5/02* (2006.01)

(52) U.S. Cl.
USPC ..... 381/17; 381/18; 381/19; 381/61; 381/74; 381/310; 381/309; 340/974; 340/975; 340/976; 340/963; 704/250; 704/246; 704/200.1; 704/500.1

(58) Field of Classification Search ..... 381/1, 17–19, 381/61, 74, 310, 309; 340/974, 975, 976, 340/963; 704/250, 246, 200.1, 500.1
See application file for complete search history.

(56) References Cited

U.S. PATENT DOCUMENTS 3,962,543 A 6/1976 Blauert et al.
5,742,689 A * 4/1998 Tucker et al. ..... 381/17
5,802,180 A * 9/1998 Abel et al. ..... 381/17
5,850,453 A * 12/1998 Klayman et al. ..... 381/1
5,982,903 A * 11/1999 Kinoshita et al. ..... 381/18
6,118,875 A 9/2000 Møller et al.
6,421,446 B1 * 7/2002 Cashion et al. ..... 381/17
6,535,640 B1 3/2003 Rajagopal et al.
6,829,361 B2 12/2004 Aarts
7,209,564 B2 4/2007 Jin et al.
7,391,877 B1 * 6/2008 Brungart ..... 381/310
7,467,021 B2 * 12/2008 Yuen et al. ..... 700/94
7,680,289 B2 * 3/2010 Sakurai et al. ..... 381/309
2006/0274901 A1 * 12/2006 Terai et al. ..... 381/17
2008/0137870 A1 * 6/2008 Nicol et al. ..... 381/17

OTHER PUBLICATIONS

Masayuki et al, Localization cues of Sound Sources in the upper hemisphere, Journal of the Acoustical Society of Japan,1984.*
Tan et al, User defined spectral manipulation of hrtf for improved localisation in 3D sound system, Electronic Letter,1998.*

(Continued)

*Primary Examiner* — Davetta W Goins
*Assistant Examiner* — Kuassi Ganmavo
(74) *Attorney, Agent, or Firm* — AFMCLO/JAZ; Chastity Whitaker

(57) ABSTRACT

A spatial audio system for implementing a head-related transfer function (HRTF). A first stage implements a lateral HRTF that reproduces the median frequency response for a sound source located at a particular lateral distance from a listener, and second stage implements a vertical HRTF that reproduces the spectral changes when the vertical distance of a sound source changes relative to the listener. The system improves the vertical localization accuracy provided by an arbitrary measured HRTF by introducing an enhancement factor into the second processing stage. The enhancement factor increases the spectral differentiation between simulated sound sources located at different positions within the same "cone of confusion."

9 Claims, 5 Drawing Sheets

OTHER PUBLICATIONS

Lalime et al, Development of an Efficient Binaural Simulation for the Analysis of Structural Acoustic DAta, Jul. 2002.*

V.R. Algazi et al., "The CIPIC HRTF Database", Proceedings of IEEE Workshop on Applications of Signal Processing to Audio and Acoustics, New Paltz, NY, Oct. 21-24, 2001, pp. 99-102.

W. Gardner et al. "HRTF measurements of a KEMAR", Journal of the Acoustical Society of America, 1995, vol. 97, pp. 3907-3908.

D. Kistler et al., "A model of head-related transfer functions based on principal components analysis and minimum-phase reconstruction", Journal of the Acoustical Society of America, 1992, vol. 91, pp. 1637-1647.

K. Koo et al. (2008). Enhancement of 3D Sound using Psychoacoustics. vol. 27, pp. 162-166.

Kulkarni, A., Isabelle, S., & Colburn, H. (1999). Sensitivity of human subjects to head-related transfer function phase spectra Journal of the Acoustical Society of America, 105(5), 2821-2840.

Langendijk, E. H. A. & Bronkhorst, A. W. (2000). Fidelity of three-dimensional-sound reproduction using a virtual auditory display the Journal of the Acoustical Society of America, 107(1), 528-537.

MacPherson, E. A. & Middlebrooks, J. C. (2003). Vertical-plane sound localization probed with ripple-spectrum noise The Journal of the Acoustical Society of America, 114(1), 430-445.

Martin, R. & MacAnally, K. (2007). Interpolation of Head-Related Transfer Functions Tech. Rep. DSTO-RR-0323, Defense Science and Technology Organization, http://dspace.dsto.defence.gov.au/dspace/bitstream/1947/8028 /1/DSTO-RR-0323.PR.pdf.

Middlebrooks, J. C. (1999a). Individual differences in external-ear transfer functions reduced by scaling in frequency The Journal of the Acoustical Society of America, 106(3), 1480-1492.

Middlebrooks, J. C. (1999b). Virtual localization improved by scaling nonindividualized external-ear transfer functions in frequency The Journal of the Acoustical Society of America, 106(3), 1493-1510.

Middlebrooks, J. C., Macpherson, E. A., & Onsan, Z. A. (2000). Psychophysical customization of directional transfer functions for virtual sound localization The Journal of the Acoustical Society of America, 108(6), 3088-3091.

Wallach, H. (1940). The role of head movements and vestibular and visual cues in sound localization Journal of Experimental Psychology, 27,339-368.

Gupta, N., Barreto, A., & Ordonez, C. (2002). Spectral modification of head-related transfer functions for improved virtual sound spatialization. *Acoustics, Speech, and Signal Processing, 2002. Proceedings*. (*ICASSP `02*). *IEEE International Conference* on vol. 2, pp. 1953-1956.

McaNally, K. I. & Martin, R. L. (2002). Variability in the Headphone-to-Ear-Canal Transfer Function Journal of the Audio Engineering Society, 50, 263-266.

Wenzel, E. (1991). Localization in virtual acoustic displays Presence, 1,80-107.

Møller, H., et al.. (1995). Head-related transfer functions of human subjects Journal of the Audio Engineering Society, 43, 300-320.

Tan, C.-J. & Gan, W.-S. (1998). User-defined spectral manipulation of HRTF for improved localisation in 3D sound systems Electronics Letters, 34(25), 2387-2389.

* cited by examiner

HEAD RELATED TRANSFER FUNCTION (HRTF) ENHANCEMENT FOR IMPROVED VERTICAL-POLAR LOCALIZATION IN SPATIAL AUDIO SYSTEMS

PRIORITY

This application claims priority from USPTO provisional patent application entitled "Head Related Transfer Function (HRTF) Enhancement for Improved Vertical-Polar Localization in Spatial Audio Displays" filed on May 20, 2009, Ser. No. 61/179,754, which is hereby incorporated by reference.

RIGHTS OF THE GOVERNMENT

The invention described herein may be manufactured and used by or for the Government of the United States for all governmental purposes without the payment of any royalty.

BACKGROUND OF THE INVENTION

The invention relates to rapidly and intuitively conveying accurate information about the spatial location of a simulated sound source to a listener over headphones through the use of enhanced head-related transfer functions (HRTFs).

HRTFs are digital audio filters that reproduce the direction-dependent changes that occur in the magnitude and phase spectra of the auditory signals reaching the left and right ears when the location of the sound source changes relative to the listener.

Head-related transfer functions (HRTFs) can be a valuable tool for adding realistic spatial attributes to arbitrary sounds presented over stereo headphones. However, in the past, HRTF-based virtual audio displays have rarely been able to reach the same level of localization accuracy that would be expected for listeners attending to real sound sources in the free field.

The present invention provides a novel HRTF enhancement technique that systematically increases the salience of the direction-dependent spectral cues that listeners use to determine the elevations of sound sources. The technique is shown to produce substantial improvements in localization accuracy in the vertical-polar dimension for individualized and non-individualized HRTFs, without negatively impacting performance in the left-right localization dimension.

The present invention produces a sound over headphones that appears to originate from a specific spatial location relative to the listener's head. One example of an application domain where this capability might be useful is in an aircraft cockpit display, where it might be desirable to produce a threat warning tone that appears to originate from the location of the threat relative to the location of the pilot. Since the 1970s, audio researchers have known that the apparent location of a simulated sound can be manipulated by applying a linear transformation known as the Head-Related Transfer Function (HRTF) to the sound prior to its presentation to the listener over headphones. In effect, the HRTF processing technique works by reproducing the interaural differences in time and intensity that listeners use to determine the left-right positions of sound sources and the pinna-based spectral shaping cues that listeners use for determining the up-down and front-back locations of sounds in the free field.

If the HRTF measurement and reproduction techniques are properly implemented, then it may be possible to produce virtual sounds over headphones that are completely indistinguishable from sounds generated by a real loudspeaker at the location where the HRTF measurement was made. Indeed, this level of real-virtual equivalence has been demonstrated in at least two experiments where listeners were unable to reliably distinguish the difference between sequentially-presented real and virtual sounds. However, demonstrations of this level of virtual sound fidelity have been limited to carefully controlled laboratory environments where the HRTF has been measured with the headphone used for the reproduction of the HRTF and the listener's head has been held completely fixed from the time the HRTF measurement was made to the time the virtual stimulus was presented to the listener.

In practical, virtual, audio display systems that allow listeners to make exploratory head movements while wearing removable headphones, it has historically been very difficult to achieve a level of localization performance that is comparable to free field listening. Listeners are generally able to determine the lateral locations of virtual sounds because these left-right determinations are based on interaural time delays (ITDs) and interaural level differences (ILDs) that are relatively robust across a wide range of listening conditions. However, listeners generally have extreme difficulty distinguishing between virtual sound locations that lie within a "cone-of-confusion." FIG. 1 shows a cone of confusion 20 where all of the possible source locations are located at the same angle β from the listener's interaural x-y-z axis 22 and thus produce roughly the same ILD and ITD cues. Within this cone-shaped region, localization judgments have to be made solely on the basis of spectral cues generated by the direction-dependent filtering characteristics of the listener's external ear. If these spectral cues are not reproduced exactly by the virtual audio display system, this can lead to extremely poor localization performance in elevation and, in cases where the stimulus is not on long enough to allow the listener to make exploratory head movements, can lead to a large number of front-back confusions as disclosed in "The role of head movements and vestibular and visual cues in sound localization." Journal of Experimental Psychology, 27, 339-368, 1940 by H. Wallach (This and all other references are herein incorporated by reference).

At least three factors conspire to make it very difficult to produce the level of spectral fidelity required to allow virtual sounds located within a cone of confusion to be localized as accurately as free-field sounds. The first relates to variability in frequency response that occurs across different fittings of the same set of stereo headphones on a listener's head. In most practical headphone designs, the variations in frequency response that occur when a headphone is removed and replaced on a listeners head are comparable in magnitude to the variations in frequency response that occur in the HRTF when a sound source changes location within a cone of confusion. This means that in most applications of spatial audio, free-field equivalent elevation performance can only be achieved in laboratory settings where the headphones are never removed from the listener's head between the time when the HRTF measurement is made and the time the headphones are used to reproduce the simulated spatial sound.

In the controlled laboratory setting used by Kulkarni, A., Isabelle, Colburn, H. (1999), "Sensitivity of human subjects to head-related transfer function phase spectra," Journal of the Acoustical Society of America, 105(5), 2821-2840, it was possible to place the headphones on the listener's head, use probe microphones inserted in the ears to measure the frequency response of the headphones, create a digital filter to invert that frequency response, and use that digital filter to reproduce virtual sounds without ever removing the headphones. This precise level of headphone correction is unachievable in real-world applications of spatial audio, particularly where display designers must account for the fact that the headphones will be removed and replaced prior to each use of the system. This can introduce a substantial amount of spectral variability into the HRTF.

Another factor that can lead to reduced localization accuracy in practical spatial audio systems is the need to use interpolation to obtain HRTFs for locations where no actual HRTF has been measured. Most studies of auditory localization accuracy with virtual sounds have used fixed impulse responses measured at discrete sound locations to do the virtual synthesis. However, most practical spatial audio systems use some form of real-time head-tracking, which requires the interpolation of HRTFs between measured source locations. A number of different interpolation schemes have been developed for HRTFs, but whenever it becomes necessary to use interpolation techniques to infer information about missing HRTF locations there is sonic possibility for a reduction in fidelity in the virtual simulation.

A final factor that has an extremely detrimental impact on localization accuracy in practical spatial audio systems is the requirement to use individualized HRTFs in order to achieve optimum localization accuracy. The physical geometry of the external ear or pinna varies across listeners, and as a direct consequence there are substantial differences in the direction-dependent high-frequency spectral cues that listeners use to localize sounds within a "cone-confusion". When a listener uses a spatial audio system that is based on HRTFs measured on someone else's ears, substantial increases in localization error can occur.

These complicating factors make it very difficult to produce a virtual audio system with directly-measured HRTF's capable of producing a high level of localization performance across a broad range of users. Consequently, a number of researchers have developed various methodologies for "enhancing" the measured HRTFs in order to improve localization performance.

Many of these enhancement methodologies involve "individualization" techniques designed to bridge the gap between the relatively high level of performance typically seen with individualized. HRTF rendering and the relatively poor level of performance that is typically seen with non-individualized HRTFs. One of the earliest examples of such a system provided listeners with the ability to manually adjust the gain of the HRTF in different frequency bands to achieve a higher level of spatial fidelity.

While there is evidence that these customization techniques can improve localization performance, they still require some modification of the HRTF to match the characteristics of the individual listener. There are many applications where this approach is not practical, and the designer will need to assume that all users of the system will be listening to the same set of unmodified non-individualized HRTFs. To this point, only a few techniques have been proposed that are designed to improve localization performance on a fixed set of HRTFs for an arbitrary listener.

One approach to solving this problem is to attempt to select the set of non-individualized HRTFs that will produce the best overall localization results across the broadest range of potential uses. This approach, which requires the measurement of HRTFs from a large number of listeners and the manual selection of the particular set of HRTFs for which the differences between the gains, in the frequency domain, from one human to another are very low, is described in U.S. Pat. No. 6,188,875 (Moller et al.).

Another approach is to actually modify the spectral characteristics of an HRTF in an attempt to obtain better localization performance. Gupta, N., Barreto, A, & Ordonez, C. (2002). "Spectral modification of head-related transfer functions for improved virtual sound spatialization," Vol. 2, pp. 1953-1956 proposed a technique that modifies the spectrum of the HRTF in an attempt to recreate the effect of increasing the protrusion angle of the listener's ear. This technique essentially increases the gain of the HRTF at low frequencies for sources it the front hemisphere, and decreases the gain of the HRTF at high frequencies for sources in the rear hemisphere. The authors reported substantial reductions in front-back confusions for the localization of non-individualized virtual sounds in the horizontal plane. However this approach failed to provide the level of precise localization in spatial audio systems provided with the present invention.

Koo, K. & Cha, H. (2008). Enhancement of 3D Sound using Psychoacoustics. Vol. 27, pp. 162-166, have recently proposed another method that uses spectral modification to reduce the confusability of two virtual sounds, such as two points located at mirror image locations across the frontal plane that would ordinarily be highly likely to result in a front-back confusion. Their method appears to take the spectral difference between the HRTFs for the two confusable locations and add this difference to the HRTF at the first location to increase the magnitude of the spectral difference between the HRTFs of the two locations by a factor of two. They did not test localization with this technique, but they do report modest improvements in mean opinion score.

These two techniques in the prior art claim to have some success in helping to resolve front-back confusions for sounds located in the horizontal plane. However, neither of these techniques makes any claim to improve elevation localization accuracy for sounds located above and below the horizontal plane. The proposed invention diners from these techniques in that it provides a way to reliably enhance auditory localization accuracy in elevation for sounds located at any desired location, in both azimuth and elevation directions, relative to the listener.

The Head Related Transfer Function (HRTF) Enhancement for Improved Vertical-Polar Localization in Spatial Audio System described herein has numerous advantages over the existing techniques in the prior art for addressing this problem, including faster response time, fewer chances for human interpretation error, and compatibility with existing auditory hardware.

SUMMARY OF THE INVENTION

A method for producing virtual sound sources over stereo headphones with more robust elevation localization performance than can be achieved with the current state-of-the-art in Head-Related Transfer Function (HRTF) based virtual audio display systems.

A spatial audio system that allows independent modification of the spectral and temporal cues associated with the lateral and vertical localization of an audio signal. The spatial audio system includes a look-up table of measured head-related transfer functions defining a measured frequency-dependent gain for a left audio signal. The spatial audio system also may include a measured frequency-dependent gain for a right audio signal, and a measured interaural time delay for a plurality of source directions. The spatial audio system also may include a signal splicer providing a left audio signal with a left frequency-dependent gain and a left time delay to a left earpiece and a right audio signal with a right frequency-dependent gain and a right time delay to a right earpiece. The left earpiece signal passes through a first filter adding a first lateral magnitude head related transfer function to the left audio signal and a second filter adding a first vertical magnitude head related transfer function scaled by an enhancement factor to the left audio signal creating a left signal output. The right earpiece signal passes through a third filter adding a second lateral head related magnitude transfer function to the right audio signal. A forth filter adds a second vertical head related magnitude transfer function scaled by an enhancement factor to the right audio signal creating a right signal output. The left signal output and right signal output delivered in stereo to provide a virtual sound, the virtual sound having a desired apparent source location and a desired level of spatial enhancement defined by the enhancement factor.

The lookup table of measured head-related transfer functions is defined on a sampling grid of apparent locations having equal spacing in a lateral dimensions and vertical dimensions.

The first vertical magnitude head related transfer function may change the left gain without changing the left time delay. The second vertical head related magnitude transfer function may change the right gain without changing the right time delay. The first lateral magnitude head-related transfer function may create a log lateral frequency-dependent gain equal to a median log frequency-dependent gain across all the measured left-ear head-related transfer functions in the lookup table with a lateral angle equal to a desired apparent source location. The first vertical magnitude head related transfer function may create a log vertical frequency-dependent gain equal to the enhancement factor multiplied by the difference between the log frequency-dependent gain of the measured left-ear head-related transfer function with the same lateral and vertical angles as the desired apparent source location; and the log frequency-dependent gain of the first lateral head-related transfer function having the same lateral angle as the desired apparent source location.

The second lateral magnitude head-related transfer function may create a second log lateral frequency-dependent gain equal to a median log frequency-dependent gain across all the measured right-ear head-related transfer functions in the lookup table with a lateral angle equal to a desired apparent source location.

The second vertical magnitude head-related transfer function may create a second log vertical frequency-dependent gain that is equal to the enhancement factor multiplied by the difference between the log frequency-dependent gain of the measured left-ear head-related transfer function with the same lateral and vertical angles as the desired apparent source location and the log frequency-dependent gain of the second lateral head-related transfer function with the same lateral angle as the desired apparent source location.

The log magnitude of the vertical head-related transfer function may be scaled by multiplying it by an enhancement factor that is selected in real time, such as by the user, or in advance, such as by the system designer.

The first lateral head-related transfer function filter and the second vertical head-related transfer function filter may be combined into an integrated head-related transfer function filter. The receiver system may include a head tracker. The receiver system may include a system for updating the selected head-related transfer functions in real time depending upon the listener head orientation with respect to a set of specified coordinates for the location of the simulated sound source, and a system for applying these frequency-dependent HRTF gain characteristics continuously to an internally or externally generated sound source. The sound source may include a tome that changes volume and frequency depending upon the listener head orientation with respect to specified coordinates.

Potential applications of the present invention include aircraft pilots, unmanned aerial vehicle pilots. SCUBA divers, parachutists astronauts. Or, more generally, applications may include any environment where your orientation to the environment can become confused and your quick reorientation can be essential.

DETAILED DESCRIPTION

The present invention includes a spectral enhancement algorithm for the HRTF that is flexible and generalizable. It allows an increase in spectral contrast to be provided to all HRTF locations within a cone-of-confusion rather than for a single set of pre-identified confusable locations. This results in a substantial improvement in the salience of the spectral cues associated with auditory localization in the up/down and front/back dimensions and can improve localization accuracy, not only for virtual sounds rendered with individualized HRTFs, but for virtual sounds rendered with non-individualized HRTFs as well.

Figure 5:
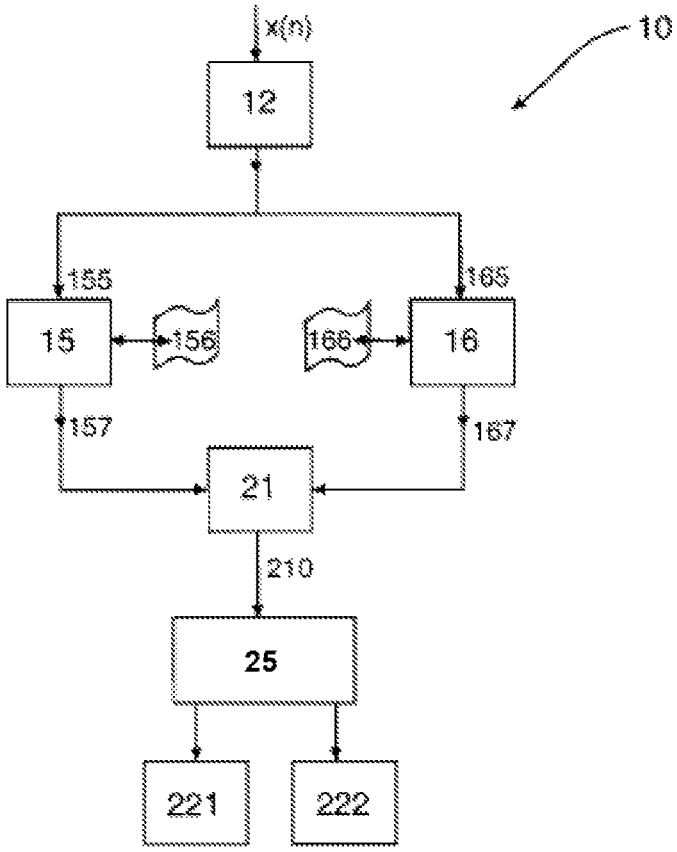
FIG. 5 is a block diagram illustration of one embodiment of the present invention.

As shown in FIG. 5 the spatial audio system 10 consists of an Analog-to-Digital (A/D) converter 12 that converts an arbitrary analog audio input signal $\chi(n)$ into the discrete-time signal $\chi[n]$ that includes a left ear signal 155 and a right ear signal 165.

A left digital filter 15 that uses a left look up table 156 to filter the left ear signal 155 input signal with the enhanced left ear (ELF) HRTF $H_{l,\theta\phi}(j\omega)$ to create a digital left ear signal 157 for creating the desired virtual source location (θ,ϕ).

A right digital filter 16 for that uses a right look up table 166 to filter the right ear signal 165 input signal with the enhanced right ear (ERE) HRTF $H_{r,\theta,\phi}(j\omega)$ to create a digital right ear signal 167 for the desired virtual source location (θ,ϕ).

A Digital-to-Analog (D/A) converter 21 takes the processed digital left ear signal 157 and the digital right ear signal 167 output signals and converts them into analog signals 210 that are presented to a listeners left and right ears via stereo headphones 25 left ear piece 221 and right ear piece 222.

In one embodiment of the present invention the inclusion of an additional control parameter, α, manipulates the extent to which the spectral cues related to changes in the vertical location of the sound source within a cone of confusion are "enhanced" relative to the normal baseline condition with no enhancement.

The implementation of α is based on a direct manipulation of the frequency domain representation of an arbitrary set of HRTFs. These HRTFs may be obtained with a variety of different HRTF measurement procedures.

Suitable HRTF measurements may be obtained by any means known in the art. Examples include HRTF procedures identified in Wightman, F. & Kistler, D. (1989). Headphone simulation of free-field listening II: Psychophysical validation Journal of the Acoustical Society of America, 85, 868-878, also Gardner, W. & Martin, K. (1995). HRTF measurements of a KEMAR Journal of the Acoustical Society of America, W, 3907-3908; and Algazi, V. R., Duda, R. O., Thompson, D. M., & Avendano, C. (2001). The CIPIC HRTF Database In Proceedings of 2001 IEEE Workshop on Applications of Signal Processing to Audio and Acoustics, New Paltz, N.Y., Oct. 21-24, 2001, pp. 99-102.

The HRTF may be characterized by a set of N measurement locations, defined in an arbitrary spherical coordinate system, with a left-ear HRTF, $h_l[n]$, and a right-ear HRTF, $h_r[n]$, associated with each of these measurement locations. These HRTFs may also be defined in the frequency domain with a separate parameter indicating the interaural time delay for each measured HRTF location. The magnitudes of the left and right ear HRTFs for each location are represented in the frequency domain by two 2048-pt FFTs, $H_l(j\omega)$ and $H_r(j\omega)$, and the interaural phase information in the HRTF for each location is represented by a single interaural time delay value that best fits the slope of the interaural phase difference in the measured HRTF in the frequency range from about 250 Hz to about 750 Hz.

Figure 1:
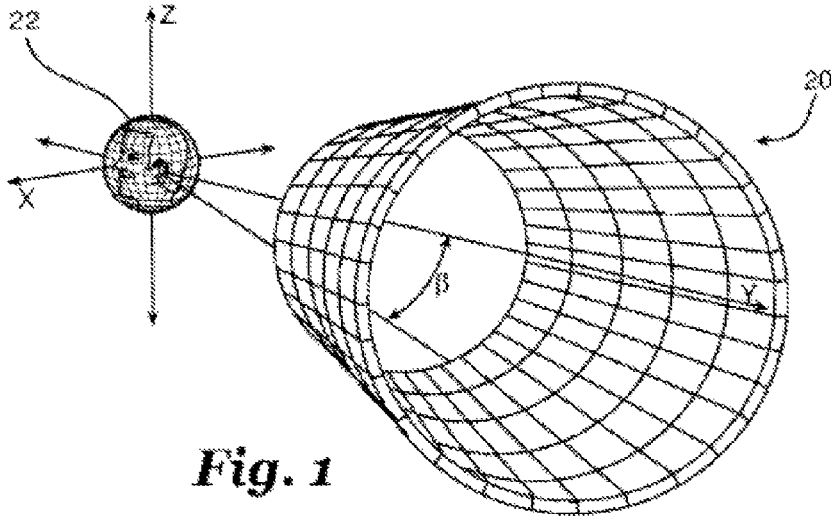
FIG. 1 is an illustration of the cone of confusion.
Figure 2:
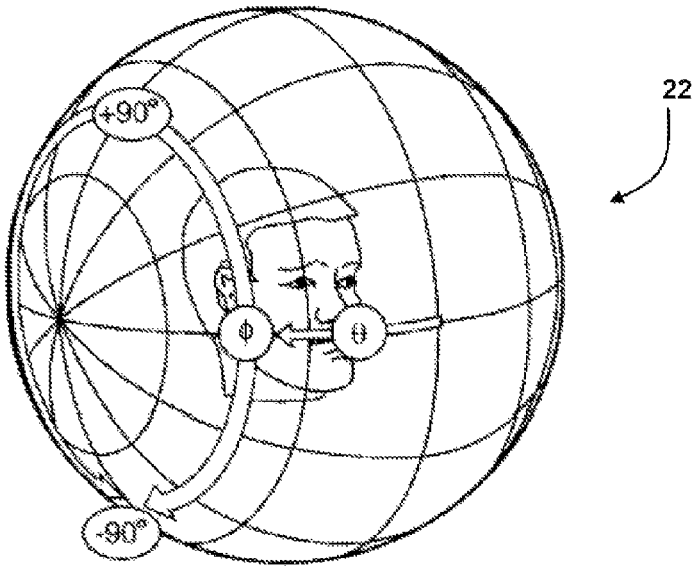
FIG. 2 is an illustration of the cone of confusion interaural-polar coordinate system used herein, where the lateral angle is designated by θ and the vertical angle is display by ϕ.

The first step in the enhancement procedure is to convert the HRTF from the coordinate system used to make the original HRTF measurements into the interaural, polar coordinate system 22 (hereafter, "interaural coordinate system 22"), which is shown in FIG. 2. In this coordinate system 22, the variable $\phi$ represents the vertical angle and is defined as the angle from the horizontal plane to a plane through the source and the interaural axis. The variable $\theta$ represents the lateral angle and is defined as the angle from the source to the median plane. The point directly in front of the listener is defined as the origin ($\theta=0°,\phi=0°$).

For each point $(\theta,\phi)$ in this coordinate system 22, we assume that the time domain representation of the HRTF for the left/right ear is defined as $h_{l/r,\theta,\phi}[n]$ and that its Discrete Fourier Transform (DFT) representation at angular frequency, $\omega$, is defined as $H_{l,\theta,\phi}(j\omega)$. In cases where no exact HRTF measurement is available for this coordinate in the interaural coordinate system 22, we assume that the HRTF for this location has been interpolated using one of any number of possible HRTF interpolation algorithms.

A sampling grid is defined for the calculation of the enhanced set of HRTFs. In one illustrative example, this grid has a spacing of five degrees both in $\theta$ and $\phi$. Within this grid, each value of $\theta$ defines the HRTFs across a unique "cone-of-confusion" 20, where the interaural difference cues (interaural time delay and interaural level differences) are roughly constant. The goal of the enhancement process is to increase the salience of the spectral variations in the HRTF within this cone-of-confusion 20, which relates to the relatively difficult-to-localize vertical dimensions (in polar coordinates) without substantially distorting the interaural difference cues in the HRTF. The HRTF relates to localization in the relatively robust left-right dimension. This can be accomplished by dividing the magnitude of the HRTF within the cone-of-confusion 20 into two components.

The first component is the "lateral" HRTF, which is designed to capture the spectral components of the HRTF that are related to left-right source location and thus do not vary substantially within a cone of confusion. The log-magnitude of the lateral HRTF is defined by the median log-magnitude HRTF across all the vertical locations within the cone 20, and is defined by $$\theta=\Theta_0:20\log_{10}(|H_{l/r,\Theta_0}^{Lat}(j\omega)|)=\text{median}[20\log_{10}(|H_{l/r,\Theta_{0,\phi}}(j\omega)|)]$$

The median HRTF value may be selected for this component rather than the mean to minimize the effect that spurious measurements and/or deep notches in frequency at a single location may have on the overall left-right component of the HRTF.

The second component includes the "vertical" HRTF within the cone 20, which is simply defined as the magnitude ratio of the actual HRTF at each location within the cone 20 divided by lateral HRTF across all the locations within the cone 20.

$$\left|H_{l/r,\Theta_0,\phi}^{Vert}(j\omega)\right| = \frac{|H_{l/r,\Theta_0,\phi}(j\omega)|}{\left|H_{l/r,\Theta_0}^{Lat}(j\omega)\right|}$$

Once these two components are calculated for all possible polar coordinates, the enhanced HRTF at each point in the sampling grid is defined by multiplying the magnitude of the lateral component of the HRTF for that source location by the magnitude of the vertical component raised to the exponent of $\alpha$. This is mathematically equivalent to multiplying the log magnitude response of the vertical component by the factor $\alpha$.

$$|H_{l/r,\alpha,\theta,\phi}^{Enh}(j\omega)|=|H_{l/r,\theta}^{Lat}(j\omega)|*|H_{l/r,\theta,\phi}^{Vert}(j\omega)|^{\alpha}$$

Here, $\alpha$ is the "enhancement" factor and is defined as the gain of the elevation-dependent spectral cues in the HRTF relative to the original, unmodified HRTF. An $\alpha$ value of 1.0, or 100%, is equivalent to the original HRTF. For convenience, the enhanced HRTFs for a particular level of enhancement are $E\alpha$, where $\alpha$ is expressed as a percentage. From this enhanced HRTF, the time domain Finite Impulse Response (FIR) filters for the 3D audio rendering can be recovered simply by taking the inverse Discrete Fourier Transform ($DFT^{-1}$) of the enhanced HRTF frequency coefficients. If necessary. HRTF interpolation techniques may also be used to convert from the interaural grid used for the enhancement calculations to any other grid that may be more convenient for rendering the HRTFs.

To a first approximation, the HRTF preserves the overall interaural difference cues associated with sound sources within the cone of confusion 20 and defined by the left-right angle $\theta$. No matter what the enhancement value is set to, the overall magnitude of the HRTF averaged across all the locations within the cone of confusion 20 is held roughly constant. Therefore, on average, the interaural difference for sounds located within a particular cone of confusion 20 will remain about the same for all values of $\alpha$. Also, because changes only the magnitude of the HRTF and not the phase, the interaural time delays are also preserved.

When the value of a is greater than 100% for an enhanced HRTF, the variations in spectrum that normally occur as a sound source moves across different locations within a cone of confusion 20 are greater than they would be in a normal HRTF. The present invention results in HRTFs that provide more salient localization cues in the vertical dimension than would normally be achieved in the prior art.

Figure 3A:
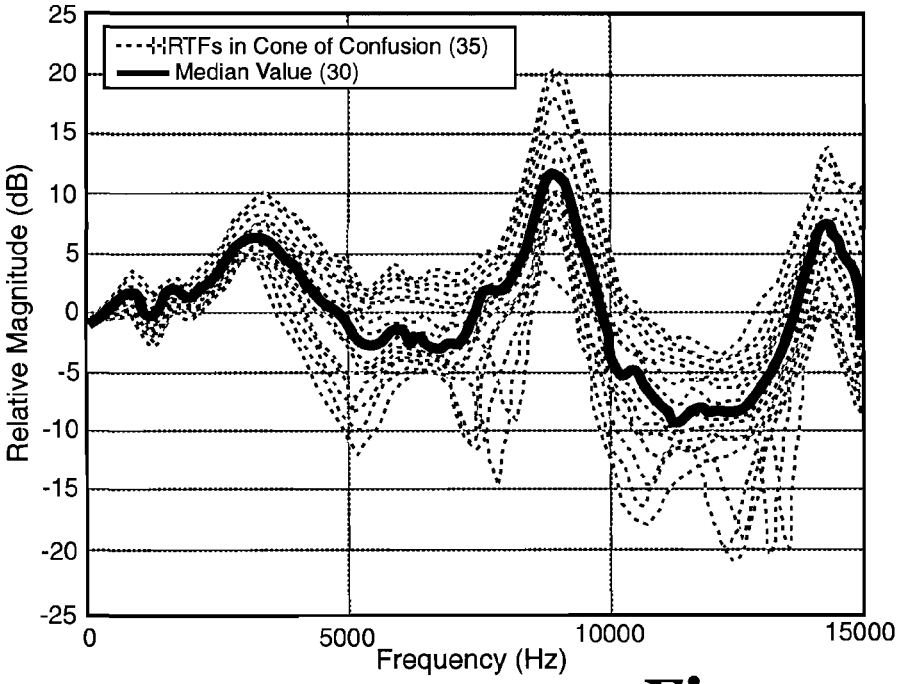
FIG. 3*a* is a graphical illustration of the cone of confusion with respect to frequency and relative magnitude.
Figure 3B:
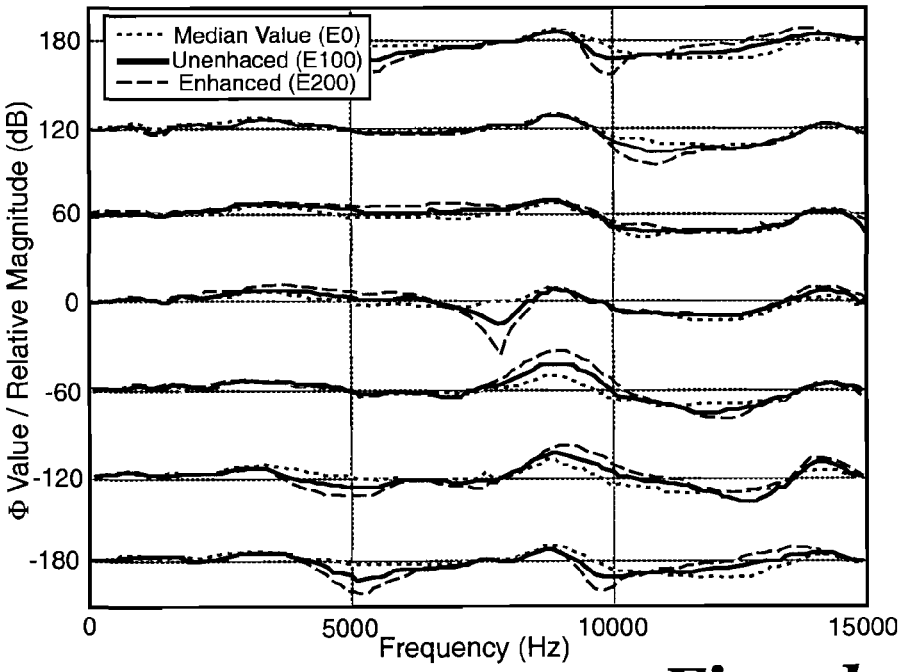
FIG. 3*b* is a graphical illustration of the effect that the HRTF enhancement has on the magnitude frequency response of the HRTF at seven different vertical angle ϕ when the lateral angle is fixed at 45 degrees.

FIGS. 3*a* and 3*b* show exemplary calculations of the enhanced HRTF for the right ear for source locations within the cone of confusion 20, for example, at $\theta=45°$. The dotted lines in FIG. 3*a* show the HRTF $|H_{r,45°,\phi}(j\omega)|$ measured at five degree intervals in $\phi$. The bold line in FIG. 3*a* shows a median magnitude HRTF 30 across all of these values, $|H_{r,45°}^{Lat}(j\omega)|$. The solid black lines in FIG. 3*b* show the unenhanced HRTFs E100 measured at 60 degree intervals in $\phi$, ranging from −180° to +180°. For comparison purposes, the dotted lines at each location of $\phi$ replot the median HRTF E0, which does not change with $\phi$ locations. The dashed lines show the enhanced HRTF E200 with an $\alpha$ value of 200%. These curves show that the elevation-dependent spectral features of the HRTF E100 are greatly exaggerated in the enhanced HRTFs E200. A nice example of this effect is the notch that occurs at roughly 8 kHz in the unenhanced HRTF E100 for $\theta$=45°, $\phi$=0° (almost exactly in the center of FIG. 3*b*). There is no sign of this notch in the median HRTF EO, or in the unenhanced HRTF E 100 for any other location in $\phi$, but in the enhanced HRTF E200, this notch is extremely prominent.

Figure 4:
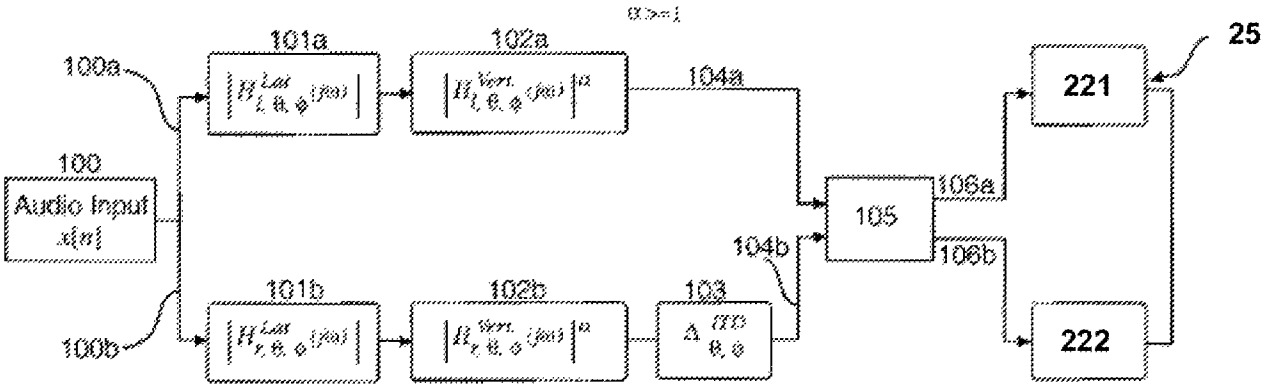
FIG. 4 is a block diagram illustration of one embodiment of the present invention.

FIG. 4 shows an overall block diagram of the mathematical calculations. The system 10 (FIG. 5) has three inputs: an arbitrary, digitized audio input signal x[n] from a source 100; a desired virtual source location coordinate ($\theta$,$\phi$); and a desired enhancement value, $\alpha$. The desired enhancement value may be a fixed value by the display designer or placed under user control with a knob.

The signal $\chi$[n] is branched into two components: a left ear output signal 100*a* and a right ear output signal 100*b*. Each signal 100*a*, 100*b* is passed through a cascade of two different digital filters each: a first left digital filter 101*a*, a first right digital filter 101*b*, a second left digital filter 102*a*, and a second right digital filter 102*b*. The first filters 101*a*, 101*b* implement the magnitude transfer function of the lateral HRTF. The second filters 102*a*, 102*b* implement the magnitude transfer function of the vertical HRTF (102*a*, 102*b*).

The lateral and vertical calculations may be performed in the reverse sequence, if desired, with the lateral calculations done before the vertical calculations.

The right ear signal 100*b* is time advanced or time delayed 103 by the appropriate number of samples to reconstruct the interaural time delay associated with the desired virtual source location. The resulting output signals 104*a*, 104*h* are converted to analog signals 106*a*, 106*b* via a D/A converter 105 and presented to left and right ear pieces 221, 222 of the headphones 25.

One potential advantage of the proposed enhancement system is that it results in much better auditory localization accuracy than existing virtual audio systems, particularly in the vertical-polar dimension. This advantage was verified in an experiment that measured auditory localization performance as a function of the level of enhancement both for individualized and non-individualized HRTFs.

EXAMPLE

Nine paid volunteers, (referred to as "listeners") ranging in age from 18 to 23, participated in the localization experiment. This experiment took place with the listeners standing in the middle of the Auditory Localization Facility (ALF), a geodesic sphere 4.3 m in diameter equipped with 277 full-range loudspeakers spaced roughly every 15° along its inside surface. Each of these speakers is equipped with a cluster of four LEDs that can be connected to a headtracking device mounted inside the sphere (InterSense IS-900) and used to create an LED "cursor" for tracking the direction of the listener's head or of a hand-held response wand. The LEDs light up a cursor at the location where the listener is pointing.

Prior to the start of this experiment, a set of individualized HRTFs for each listener were measured in the ALF facility using a periodic chirp stimulus generated from each loudspeaker position. These HRTFs were time-windowed to remove reflections and used to derive 256-point, minimum-phase left- and right-ear HRTF filters for each speaker location in the sphere. A single value representing the interaural time delay for each source location was also derived. The HRTFs were also corrected for the frequency response of the Beyerdynamic DT990 headphones used in the experiment.

The measured HRTFs were then used to generate three sets of enhanced HRTFs. A baseline set of HRTFs with no enhancement (indicated as E100 on FIGS. 6*a*-6*c*), a set of HRTFs where the elevation-dependent spectral features in the HRTF were increased 50% relative to their normal size (indicated as E150 on FIGS. 6*a*-6*c*), and a set of HRTFs where the spectral features were increased to double their normal size (indicated as E200 on FIGS. 6*a*-6*c*). In addition, a set of five enhanced HRTFs (E100, E150, E200, E250, and E300 on FIGS. 6*a*-6*c*) were generated from an HRTF measurement made on the Knowles Electronics Manikin for Auditory Research (KEMAR), a standardized anthropomorphic manikin that is commonly used for spatial audio research.

These processed HRTFs were then used to collect localization responses. The listeners entered the sphere and put on a headset equipped with a head tracking sensor (Intersense IS-900). This headset was connected to a control computer that rendered the processed HRTFs in real time using the Sound Lab (SLAB) software library, which was developed by J. D. Miller, "SLAB: A software-based real-time virtual acoustic environment rendering system." [Demonstration], ICAD 2001, 9th Intl. Conf. on Aud. Disp., Espoo, Finland, 2001. The listeners then completed a block of 44-88 localization trials.

First, a visual cursor that turned on the LED at the speaker located in direction of the listener's head was turned on and moved to the loudspeaker location in front of the sphere. This ensured that the listener's head was facing toward the reference-frame origin prior to the start of the trial.

Second, the listener pressed a button to initiate the onset of a 250 ms burst of broadband noise (15 kHz bandwidth) that was processed to simulate one of the 224 possible speaker locations in the ALF facility with an elevation greater than −45°.

Third, a visual cursor that turned on the LED at the speaker located in the direction of the listener's response wand was turned on. The listener moved the wand until this cursor was located at the perceived location of the sound source and pressed the response button.

Finally, feedback was provided by turning on the LED at the actual location of the sound source, which was acknowledged by a button press. The head-slaved cursor was again turned on and used to orient the listener's head towards the front loudspeaker prior to the next trial.

A total of 12 different conditions were tested with each listener. Three of the conditions were "individualized" HRTF conditions where the listeners heard their own HRTFs processed with the enhancement procedure outlined above at the E100 E159, or E200 level. Three of the conditions were "non-individualized" HRTF conditions, where the listeners heard E100, E150, or E200 HRTFs that were measured on a different listener. For these conditions, the HRTFs of two of the nine listeners were selected for use as "non-individualized" HRTFs, and all seven of the other participants listened to the HRTFs from these same two listeners. The two listeners used for the non-individualized HRTFs listened to each other's HRTFs in the non-individualized condition, but not their own. Five of the conditions involved HRTFs measured on a KEMAR manikin and processed at the E100, E150, E200, E250, or E300 level. And the last condition was a control condition where no headphones were worn and, the listeners localized stimuli that were presented directly from the loudspeakers in the ALF facility. The listeners heard the same HRTF condition throughout a block of trials, although they would often collect 2-3 blocks of trials in a single 30 minute experimental session. Over the course of the experiment, which lasted several weeks, each listener participated in a minimum of 132 trials in each of the 12 conditions of the experiment.

When the enhancement algorithm was applied to the HRTFs, performance increased across all conditions tested. In the individualized condition, the E150 condition improved overall localization performance by approximately 3 degrees, from 16° to 13°, bringing performance up to almost exactly the same level achieved in the loudspeaker control condition. However, additional enhancement to the E200 level in the individualized condition actually degraded performance, which would suggest that, in the individualized HRTF case, over-enhancement may distort the spectral HRTF cues too much for listeners to take full advantage of their inherent experience with their own transfer functions. However, no such limitations were found for the improvements provided by enhancement in the non-individualized and KEMAR conditions. In those conditions, overall angular errors systematically decreased at the enhanced increased from E100 to E200, reducing the error in the non-individualized condition from roughly 28° to 22°. In the KEMAR condition, even greater improvements were obtained for enhancement levels out to E300. From these results, it is clear that the HRTF enhancement procedure is very effective for improving performance in localization tasks.

The improvements in the vertical dimension performance provided by the enhancement algorithm are dramatic, resulting in as much as a 33% reduction in vertical localization error. These results clearly show that the enhancement procedure was very effective at achieving its goal of improving the salience of the spectral cues that listeners use to determine the locations of sounds within a single cone of confusion.

Figure 6A:
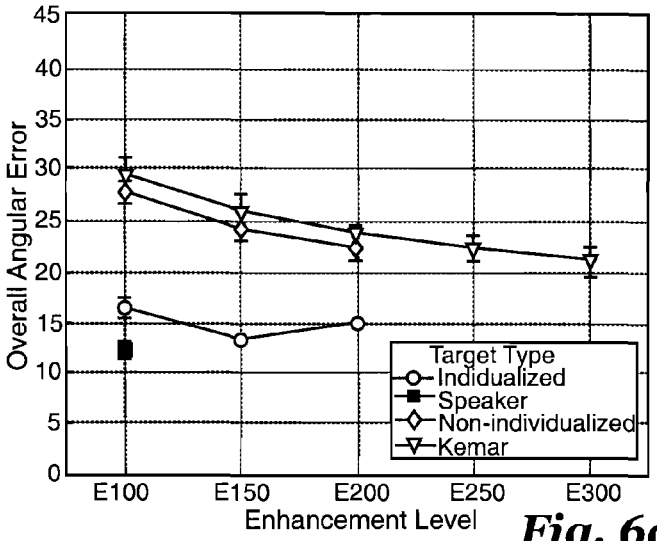
FIGS. 6*a* through 6*c* are graphical illustrations of the improved performance of the present invention and showing the error in localization accuracy of virtual sounds with respect to various enhancement levels.
Figure 6B:
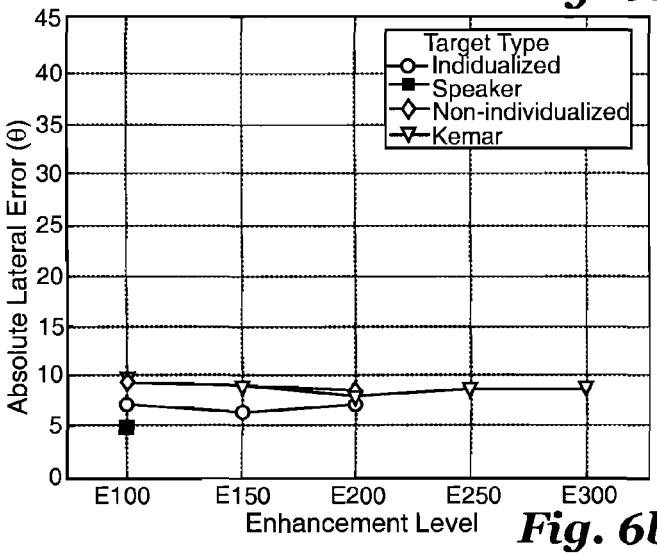
Figure 6C:
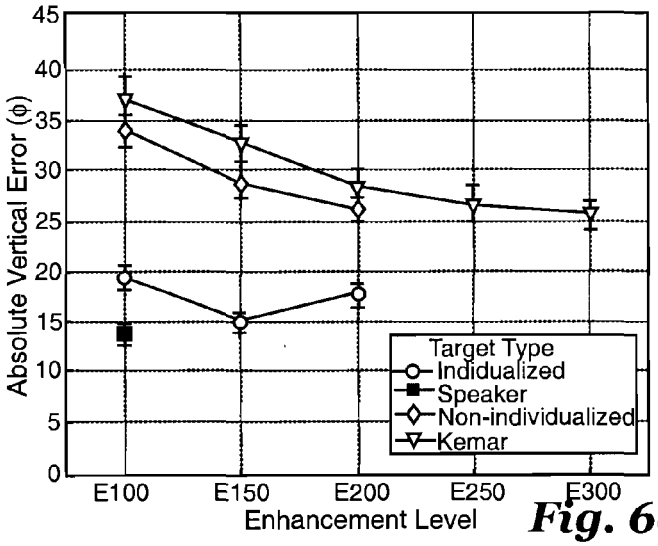

The results of the psychoacoustic testing in FIGS. 6*a*, 6*b* and 6*c* demonstrate an advantage of the HRTF enhancement algorithm: a substantial improvement in localization accuracy of virtual sounds in the vertical dimension. However, it may be noted that the system has some other advantages compared to other methods that have been proposed to improve virtual audio localization performance.

The present invention enhancement technique makes no assumptions about how the HRTFs were measured. The method does not require any visual inspection to identify the peaks and notches of interest in the HRTF, nor does it require any hand-tuning of the output filters to ensure reasonable results. Also, it may be noted that, because the method is applied relative to the median HRTF within each cone of confusion, it ignores characteristics of the HRTF that are common across all source locations. Thus, it may be applied to an HRTF that has already been corrected to equalize for a particular headphone response without requiring any knowledge about how the original HRTF was measured, what it looked like prior to headphone correction, or how that headphone response was implemented.

The HRTF enhancement algorithms previously proposed have focused on improving performance for non-individualized HRTF and have not been shown to improve performance for individualized HRTFs. The proposed invention has been shown to provide substantial performance improvements for individualized HRTFs, presumably, in part, because it overcomes the spectral distortions that typically occur as a result of inconsistent headphone placement.

The enhancement algorithm disclosed herein does not require the implementer to make any judgments about particular pairs of locations that produce localization errors and need to be enhanced. When the enhancement parameter, $\alpha$, is greater than 100%, the algorithm provides an improvement in spectral contrast between any two points located anywhere within a cone of confusion.

Because the system works by enhancing existing localization cues rather than adding new ones, listeners are able to take advantage of the enhancements without any additional training. The HRTF enhancement system may be applied to any current or future implementation of a head-tracked virtual audio display. The enhancement system may have application where HRTFs or HRTF-related technology is used to provide enhanced spatial cueing to sound. In particular, this includes speaker-based "transaural" applications of virtual audio and headphone-based digital audio systems designed to simulate audio signals arriving from fixed positions in the free-field, such as the Dolby Headphone system.

There are many possible applications where it may be desirable to divide the head-related transfer function into a lateral component and a vertical component, and then to apply an enhancement algorithm differentially to the vertical component of the HRTF. This might include a linear enhancement factor that varies as a function of frequency, which could be defined as a function of frequency $\alpha(f)$), or a linear enhancement factor that varies with a desired apparent source direction, or some combination thereof. It may also include some non-linear processing, such as an enhancement factor applied only to peaks in the vertical HRTF but not to dips.

While specific embodiments have been described in detail in the foregoing description and illustrated in the drawings, those with ordinary skill in the art may appreciate that various modifications to the details provided could be developed in light of the overall teachings of the disclosure.

What is claimed is:

1. A spatial audio system with lateral and vertical localization of an audio signal comprising a left audio signal and a right audio signal, the spatial audio system comprising:

a receiver system having left and right earpieces;

a look-up table of measured head-related transfer functions, each of the transfer functions defining a left measured frequency-dependent gain for the left audio signal, a right measured frequency-dependent gain for the right audio signal, and a measured interaural time delay for a plurality of source directions, a signal splicer configured to provide (i) the left audio signal with the left measured frequency-dependent gain and a left time delay to the left earpiece and (ii) the right audio signal with the right measured frequency-dependency gain and a right time delay to the right earpiece;

first and second filters between the signal splicer and the left earpiece and, together, configured to create a left signal output, the first filter configured to add a first lateral magnitude head-related transfer function to the left audio signal and the second filter configured to add a first vertical magnitude head-related transfer function scaled by a first enhancement factor to the left audio signal;

third and fourth filters between the signal splicer and the right earpiece and, together, configured to create a right signal output, the third filter configured to add a second lateral head-related magnitude transfer function to the right audio signal and the fourth filter configured to add a second vertical head-related magnitude transfer function scaled by a second enhancement factor to the right audio signal; and the left signal output and right signal output delivered to the respective left and right earpieces to provide a virtual sound, the virtual sound having a desired apparent source location and a desired level of spatial enhancement, the desired apparent source location having a desired apparent lateral angle with respect to a lateral dimension and a desired apparent vertical angle with respect to a vertical dimension, wherein the first lateral magnitude head-related transfer function is configured to output a first log lateral frequency-dependent gain equal to a median log frequency-dependent gain across all left measured frequency-dependent gains having the desired apparent lateral angle, the first vertical magnitude head-related transfer function is configured to output a first log vertical frequency-dependent gain equal to the first enhancement factor multiplied by a difference between the left measured frequency dependent gain at the desired apparent source location and the first lateral magnitude head-related transfer function, the second lateral magnitude head-related transfer function is configured to output a second log lateral frequency-dependent gain equal to a median log frequency-dependent gain across all the right measured frequency-dependent gains having the desired apparent lateral angle, and the second vertical magnitude head-related transfer function is configured to output a second log vertical frequency-dependent gain equal to the second enhancement factor multiplied by a difference between the right measured frequency dependent gain at the desired apparent source location and the second lateral magnitude head-related transfer function.

2. The spatial audio system of claim 1 wherein the lookup table of measured head-related transfer functions is defined on a sampling grid of a plurality of apparent locations, adjacent ones of the plurality of apparent locations being equally spaced in lateral dimension and the vertical dimension.

3. The spatial audio system of claim 1 wherein the first vertical magnitude head-related transfer function changes the left measured frequency dependent gain without changing a left time delay and the second vertical head-related magnitude transfer function changes the right measured frequency dependent gain without changing a right time delay.

4. The spatial audio system of claim 1 wherein the log-magnitude of the unsealed vertical polar head-related transfer function is scaled by an enhancement factor that is selected in real time by a user or in advance by a system designer.

5. The spatial audio system of claim 1 wherein the first lateral head-related transfer function filter and the second vertical-polar head-related transfer function filter are combined into an integrated head-related transfer function filter.

6. The spatial audio system of claim 1 wherein the receiver system includes a head tracker.

7. The spatial audio system of claim 1 wherein the receiver system is further configured to generate a tone that changes volume and frequency with movement of a listener head with respect to the lateral and vertical dimensions.

8. The spatial audio system of claim 1 wherein the first enhancement factor and the second enhancement factor are equivalent.

9. The spatial audio system of claim 1 wherein the first enhancement factor and the second enhancement factor are frequency and direction dependent functions.

* * * * *